US011395937B2

(12) United States Patent
Lopez

(10) Patent No.: US 11,395,937 B2
(45) Date of Patent: Jul. 26, 2022

(54) FOOT AND LEG STRETCHING DEVICE

(71) Applicant: Vive Health LLC, Naples, FL (US)

(72) Inventor: Juan Lopez, Naples, FL (US)

(73) Assignee: Vive Health LLC, Naples, FL (US)

( * ) Notice: Subject to any disclaimer, the term of this patent is extended or adjusted under 35 U.S.C. 154(b) by 0 days.

(21) Appl. No.: 17/073,197

(22) Filed: Oct. 16, 2020

(65) Prior Publication Data

US 2022/0118312 A1 Apr. 21, 2022

(51) Int. Cl.

| | |
|---|---|
| ***A63B 23/10*** | (2006.01) |
| ***A63B 21/00*** | (2006.01) |
| ***A63B 23/035*** | (2006.01) |
| ***A63B 22/16*** | (2006.01) |

(52) U.S. Cl.

CPC ..... *A63B 23/10* (2013.01); *A63B 21/4034* (2015.10); *A63B 21/4047* (2015.10); *A63B 23/03508* (2013.01); *A63B 22/16* (2013.01)

(58) Field of Classification Search

CPC ..... A63B 21/4047; A63B 23/03508; A63B 22/16; A63B 23/08–10; A63B 21/4033–4034; A61H 1/02; A61H 1/0237; A61H 1/0266; A61H 2205/106; A61H 2205/12; A61H 2205/125; A61H 2201/1676

See application file for complete search history.

(56) References Cited

U.S. PATENT DOCUMENTS 478,166 A 7/1892 Name not Available
3,960,027 A 6/1976 Magnuson
D278,293 S 4/1985 Strang
4,951,938 A * 8/1990 Smith, IV ..... A63B 21/0004 482/80
D320,703 S 10/1991 Burkhart
D323,367 S 1/1992 Smith
5,135,450 A * 8/1992 Smith, IV ..... A63B 22/16 36/110
5,197,932 A * 3/1993 Smith, IV ..... A63B 22/16 482/146
D341,031 S 11/1993 Burkhart
5,713,820 A 2/1998 Carbone
(Continued)

OTHER PUBLICATIONS

U.S. Appl. No. 29/755,117, filed Oct. 16, 2020, Vive Health LLC.
(Continued)

*Primary Examiner* — Jennifer Robertson
*Assistant Examiner* — Catrina A Letterman
(74) *Attorney, Agent, or Firm* — Workman Nydegger

(57) ABSTRACT

A stretching device includes a heel platform sized and shaped to support a heel of a foot of a person thereon. The stretching device also includes a ball platform sized and shaped to support a ball of a foot of a person thereon. The ball platform is angularly offset relative to the heel platform. The stretching device includes one or more connection members connecting the heel platform to the ball platform. The stretching device includes an extension slot connected to the ball platform. The stretching device includes a stretching device extension. The stretching device extension includes an extension platform arranged coplanar with the ball platform. The stretching device extension includes an extension insert arranged within and selectively removable from the extension slot.

20 Claims, 5 Drawing Sheets

(56) References Cited

U.S. PATENT DOCUMENTS

| | | | | |
|---|---|---|---|---|
| 5,871,298 | A | 2/1999 | Lekhtman | |
| 5,897,464 | A | 4/1999 | Mcleod | |
| 5,916,071 | A | 6/1999 | Lee | |
| 6,231,485 | B1 * | 5/2001 | Dreissigacker | A63B 21/227 482/57 |
| 6,318,001 | B1 | 11/2001 | Lee | |
| 6,447,429 | B1 | 9/2002 | Chen | |
| 8,529,411 | B2 | 9/2013 | DiGiovanni | |
| 9,962,574 | B2 | 5/2018 | Sperry | |
| D825,696 | S | 8/2018 | Mercenari Uribe | |
| 11,103,740 | B2 * | 8/2021 | Boyles | A63B 21/4035 |
| 2004/0110604 | A1 * | 6/2004 | Chen Wu | A63B 23/10 482/79 |
| 2004/0259704 | A1 * | 12/2004 | Liang | A63B 22/16 482/146 |
| 2005/0164845 | A1 * | 7/2005 | DiGiovanni | A43B 7/00 482/79 |
| 2010/0035734 | A1 * | 2/2010 | DiGiovanni | A63B 23/085 482/79 |
| 2011/0269605 | A1 | 11/2011 | Kim | |
| 2014/0100086 | A1 | 4/2014 | Pagliaro | |

OTHER PUBLICATIONS

U.S. Appl. No. 29/755,117, filed Dec. 14, 2021, Office Action.

U.S. Appl. No. 29/755,117, filed Mar. 30, 2022, Notice of Allowance.

Amazon prime, announced 2019[online], [site visited Mar. 21, 2022]. Available on internet, URL:https://www.amazon.com/ Nonslip-Aluminum-Electric-Assembly-Welding/dp/B07P6R5S4H/ref (Year: 2019).

Powerstepstore, announced 2016[online], [site visited Nov. 19, 2021], Available on internet, URL:https://www.amazon.com/ Powerstep-UltraFlexx-Rocker-Stretcher-Calves/dp/B0 1 L6PKH FK/ref (Year: 2016).

Stepit, announced 2016[online], [site visited Nov. 19, 2021], Available on internet, URL:https://www.amazon.com/ Rocking-Foot-Pedal-Circulation-Alternative/dp/B07MG8N6J5/ref (Year: 2016).

* cited by examiner

FOOT AND LEG STRETCHING DEVICE

BACKGROUND

Many individuals desire to stretch parts of one or more of their feet and/or legs for general wellness purposes or to treat injuries (e.g., plantar fasciitis). However, many individuals find difficulty in achieving effective stretching ranges. For example, geriatrics, injured persons, and/or others may experience difficulty or inability in positioning their feet and/or legs relative to conventional structures (e.g., stairs, flooring, stools, etc.) and/or devices to facilitate stretching. For example, it may be difficult for multiple persons to use the same stretching device due to lack in size adaptability or other constraints.

For at least the foregoing reasons, there is an ongoing need and desire for improved foot and leg stretching devices.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Implementations of the present disclosure extend to devices for facilitating foot and leg stretching.

Some embodiments provide a stretching device that includes a heel platform sized and shaped to support a heel of a foot of a person thereon. The stretching device also includes a ball platform sized and shaped to support a ball of a foot of a person thereon. The ball platform may be angularly offset relative to the heel platform.

The stretching device may also include one or more connection members connecting the heel platform to the ball platform. Furthermore, the stretching device may also include an extension slot connected to the ball platform. In addition, the stretching device may include a stretching device extension. The stretching device extension may include an extension platform. The stretching device extension may include an extension insert arranged within and selectively removable from the extension slot. The extension platform of the stretching device extension may be arranged coplanar with the ball platform when the extension slot receives the extension insert of the stretching device extension.

In some embodiments, the stretching device may include an inner connection member extending between the heel platform and the ball platform. The inner connection member may define a foot gap between the heel platform and the ball platform. Furthermore, the stretching device may include an outer connection member extending between the heel platform and the ball platform. The stretching device may also include a plurality of connection member supports that extend from the inner connection member to the outer connection member. The plurality of connection member supports may include a plurality of surfaces that curve toward the ball platform. Also, the stretching device may include an additional support extending from the ball platform to the outer connection member. The additional support may also curve toward the ball platform.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings.

DETAILED DESCRIPTION

Figure 1:
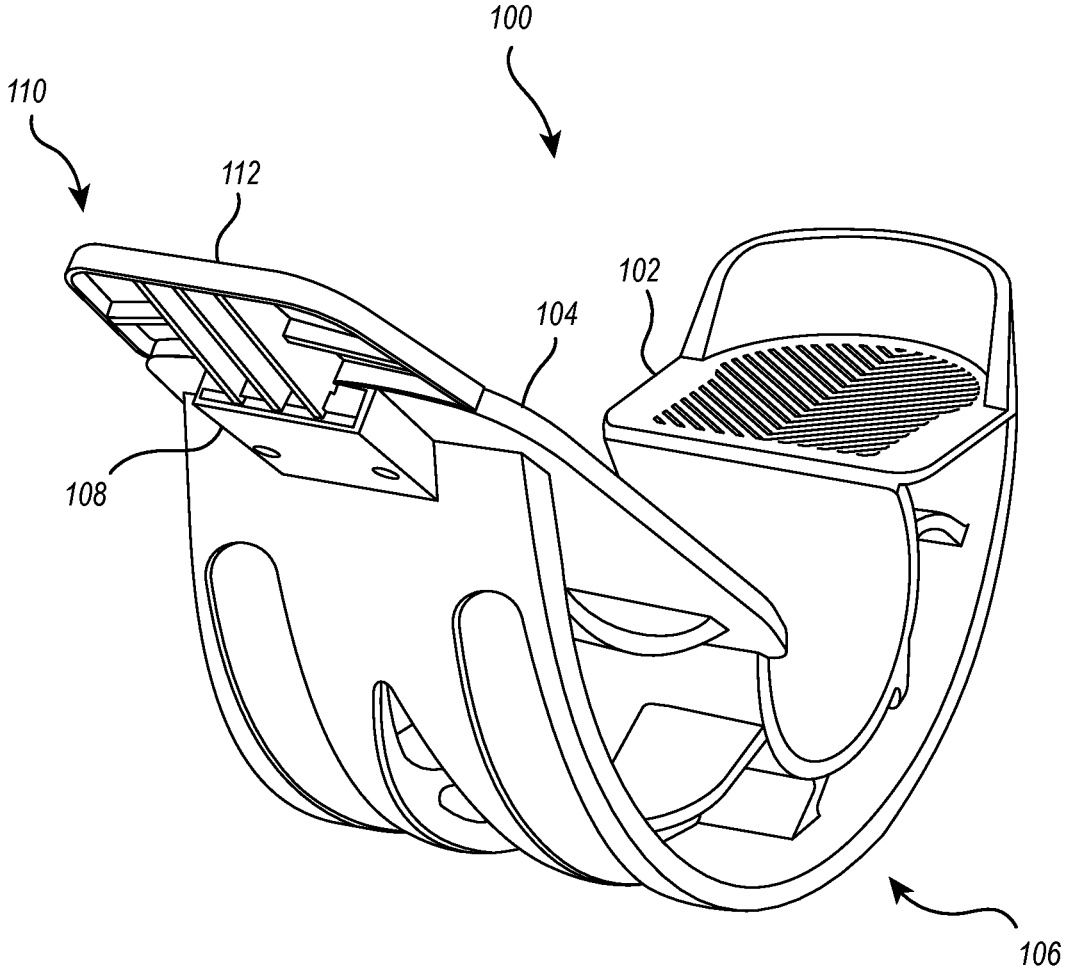
FIG. 1 illustrates a front perspective view of a stretching device that includes a stretching device extension affixed thereto.

Implementations of the present disclosure extend to devices for facilitating foot and leg stretching.

In some implementations, a stretching device includes a heel platform sized and shaped to support a heel of a foot of a person thereon. The stretching device also includes a ball platform sized and shaped to support a ball of a foot of a person thereon. The ball platform may be angularly offset relative to the heel platform. The stretching device may also include one or more connection members connecting the heel platform to the ball platform. Furthermore, the stretching device may also include an extension slot connected to the ball platform. In addition, the stretching device may include a stretching device extension. The stretching device extension may include an extension platform arranged coplanar with the ball platform. The stretching device extension may include an extension insert arranged within and selectively removable from the extension slot.

In some implementations, a stretching device includes a heel platform sized and shaped to support a heel of a foot of a person thereon. The stretching device may also include a ball platform sized and shaped to support a ball of a foot of a person thereon. The ball platform may be angularly offset relative to the heel platform. The stretching device may include an inner connection member extending between the heel platform and the ball platform. The inner connection member may define a foot gap between the heel platform and the ball platform. Furthermore, the stretching device may include an outer connection member extending between the heel platform and the ball platform. The stretching device may also include a plurality of connection member supports that extend from the inner connection member to the outer connection member. The plurality of connection member supports may include a plurality of surfaces that curve toward the ball platform. Also, the stretching device may include an additional support extending from the ball platform to the outer connection member. The additional support may also curve toward the ball platform.

Those skilled in the art will recognize, in view of the present disclosure, that at least some of the disclosed embodiments may be implemented to address various difficulties associated with facilitating foot or leg stretching.

For example, a stretching device according to the present disclosure may include an arrangement of angularly offset plates with a foot gap intervening therebetween for providing ideal foot arrangement when a foot is positioned on the plates. Furthermore, a stretching device of the present disclosure provides stable rocking functionality (e.g., via a bottom grip material) to allow users to achieve foot or leg positions that stretch the users' feet, Achilles tendon, calf muscles, and/or other portions of the leg. In addition, in some instances, the rocking functionality of a stretching device of the present disclosure may enable users to achieve foot and/or leg stretching from a sitting or standing position. A stretching device of the present disclosure may assist users recovering from plantar fasciitis and/or other injuries or conditions.

In some implementations, a stretching device of the present disclosure includes a heel plate extending from a back portion thereof to allow users to easily maintain proper foot placement on the device during use. Furthermore, in some instances, one or more of the platforms of a stretching device of the present disclosure include ridges/treads to prevent a user's foot or footwear from slipping from placement on the stretching device during use. In addition, a stretching device of the present disclosure may include a non-slip element (e.g., a rubber pad) to prevent slipping of the stretching device during use for stretching (e.g., during rocking motions).

A stretching device of the present disclosure may be configured to fit a broad range of foot/footwear sizes, such as up to a men's size 15. Furthermore, in at least some implementations, a stretching device of the present disclosure includes a selectively removable stretching device extension to allow the stretching device to accommodate even larger foot/footwear sizes (e.g., greater than a men's size 15).

Having described some of the various high-level features and benefits of the disclosed embodiments, attention will now be directed to FIGS. 1 through 6. These Figures illustrate various supporting illustrations related to the disclosed embodiments.

FIG. 1 illustrates a front perspective view of a stretching device 100, according to implementations of the present disclosure As shown in FIG. 1, the stretching device 100 includes a heel platform 102, a ball platform 104, and connection members 106 connecting the heel platform 102 to the ball platform 104 and extending from the heel platform 102 to the ball platform 104. Additional details relating to the connection members 106 will be provided hereinafter.

In some implementations, the heel platform 102 is sized and shaped to support a heel of a foot of a person. Furthermore, in some implementations, the ball platform 104 is sized and shaped to support a ball of a foot of a person. Furthermore, as is evident in FIG. 1, the ball platform 104 may be angularly offset relative to the heel platform 102. In this way, the heel platform 102 and the ball platform 104 may be regarded as being arranged non-coplanar to one another. In some instances, the angularly offset arrangement of the heel platform 102 and the ball platform 104 enables the stretching device 100 to facilitate an ideal foot arrangement for achieving stretching ranges for users.

The stretching device 100 illustrated in FIG. 1 also includes an extension slot 108 connected to the ball platform 104. As is shown in FIG. 1, the extension slot 108 receives a stretching device extension 110, and the stretching device extension 110 includes an extension platform 112. The extension platform 112 may operate as an extension of the ball platform 104. For example, the extension platform 112 may become arranged parallel to the ball platform 104 when the stretching device extension 110 is connected to the stretching device 100 via the extension slot 108. When so arranged, the extension platform 112 may be configured to support the ball or toes of a foot of a person using the stretching device 100, even for persons with large foot sizes (e.g., above men's size 15).

Figure 2:
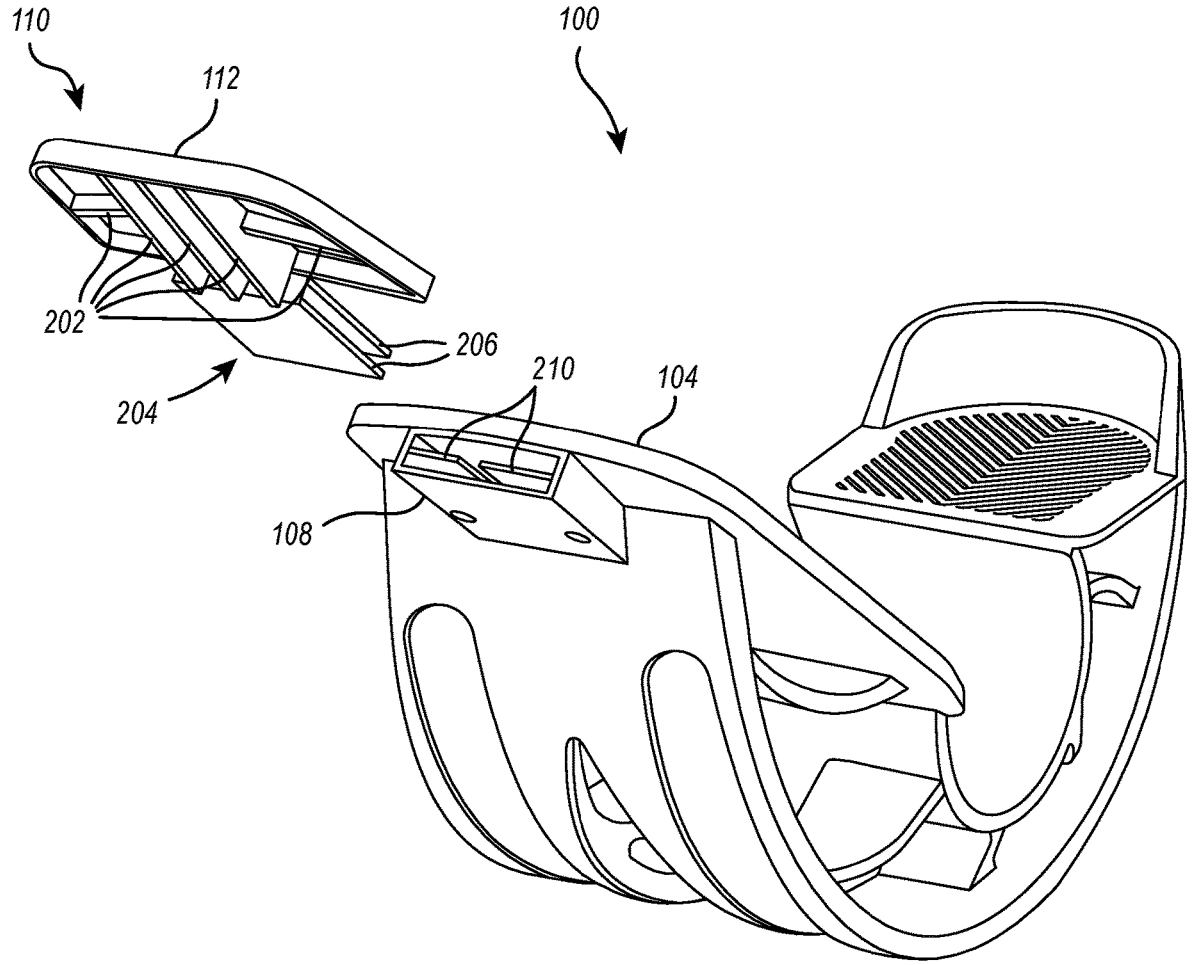
FIG. 2 illustrates a front perspective view of the stretching device with the stretching device extension selectively removed therefrom.

FIG. 2 illustrates a front perspective view of the stretching device 100 with the stretching device extension 110 selectively removed therefrom. Providing a stretching device 100 with a selectively removable stretching device extension 110 may allow the stretching device 100 to selectively accommodate users with large foot sizes while also realizing other benefits such as portability (e.g., for travel), versatility (e.g., extensions of different sizes may be used with the stretching device 100), and/or others.

In some implementations, as shown in FIG. 2, the extension slot 108 is connected to an underside of the ball platform 104. FIG. 2 also illustrates that, in some instances, the extension slot 108 includes a substantially rectangular opening. However, the arrangement and/or form of the extension slot 108 relative to the ball platform 104 shown in FIG. 2 is non-limiting. For instance, in other implementations, the extension slot 108 is integrated into the ball platform 104, such that the ball platform 104 at least partially defines the extension slot 108. As another example, the extension slot 108 may comprise an opening of any shape, such as a triangular, pentagonal, or other polygonal shape, or an at least partially curved shape.

Figure 6:
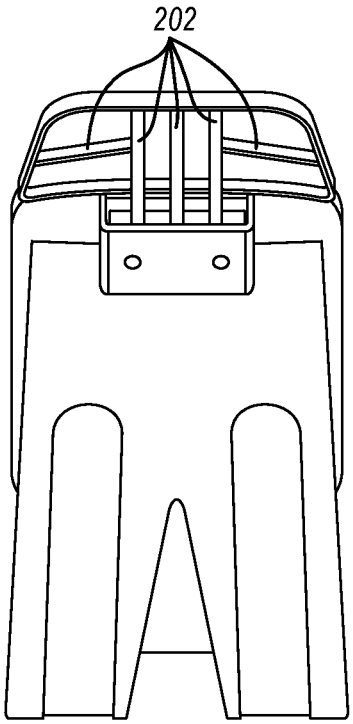
FIG. 6 illustrates a front elevational view of the stretching device with the stretching device extension attached thereto.

FIG. 2 furthermore illustrates that, in some implementations, the stretching device extension 110 includes extension supports 202, which may be disposed, in some instances, under the extension platform 112. FIG. 6, which illustrates a front elevational view of the stretching device 100 and stretching device extension 110, also provides an additional view of the extension supports 202. FIGS. 2 and 6 show that, in some implementations, the extension supports 202 form planar members that extend substantially orthogonally downward from the underside of the extension platform 112.

In the specific example shown in FIGS. 2 and 6, three of the extension supports 202 are disposed under the extension platform 112 in a linear arrangement, such that the three of the extension supports 202 are arranged parallel to one another in a front-to-back direction relative to the stretching device extension 110. The example of FIGS. 2 and 6 also illustrates an additional pair of extension supports 202 that are arranged nonparallel to the three linearly arranged extension supports 202. The extension supports 202 of the additional pair of extension supports 202 are also arranged nonparallel to one another. Each of the extension supports 202 of the additional pair of extension supports 202 extend from a lateral side of a respective one of the three linearly arranged extension supports 202 toward a respective side of the stretching device extension 110. Furthermore, FIGS. 2 and 6 show an example in which the extension supports 202 of the additional pair of extension supports 202 comprise a different height relative to the three linearly arranged extension supports 202.

The extension supports 202 may provide structural support to the extension platform 112 to enable the extension platform 112 to stably support toes or a portion of a ball of a foot of a user to enable the user to achieve desired foot and/or leg stretching ranges using the stretching device 100 in conjunction with the stretching device extension 110. However, those skilled in the art will appreciate, in view of the present disclosure, that the particular form and/or arrangement of the extension supports 202 of the stretching device extension 110 may be varied in accordance with implementations of the present disclosure.

For example, the various extension supports may have different shapes and/or sizes relative to one another (e.g., the additional pair of extension supports 202 have a different size than the three linearly arranged extension supports 202 of FIGS. 2 and 6). Furthermore, in some instances, the extension supports 202 may take on other shapes than the substantially planar shown in FIGS. 2 and 6, such as cylindrical (e.g., rod-like) or other shapes. In addition, although FIGS. 2 and 6 illustrates five continuous extension supports 202 arranged under the extension platform 112, a stretching device extension 110 may include any number of extension supports 202, which may or may not be continuous, with any number of arrangement schemes (e.g., linear arrangement vs nonparallel arrangement).

FIG. 2 also illustrates that the stretching device extension 110 may include an extension insert 204 attached thereto. In the example shown in FIG. 2, the extension insert 204 is affixed to and extends from at least some of the extension supports 202, such as to the three linearly arranged extension supports 202 described hereinabove. FIG. 2 illustrates the extension insert 204 as including extension insert interface members 206 that extend from the extension supports 202 and/or extension platform 112. In some instances, as shown in FIG. 2, the extension insert interface members 206 of the extension insert 204 form planar members and are arranged substantially parallel to the extension platform 112 and substantially perpendicular relative to the extension supports 202.

The extension insert 204 may be configured (e.g., via the extension insert interface members 206) for insertion into the extension slot 108 of the stretching device 100. For example, in some instances, the extension slot 108 includes extension slot interface members 210, which may be configured to interface with the extension insert interface members 206 to removably secure the stretching device extension 110 to the stretching device 100. A user may insert the extension insert 204 into the extension slot 108 such that surfaces of the extension insert interface members 206 abut surfaces of the extension slot interface members 210, thereby creating static frictional force that removably secures the stretching device extension 110 to the stretching device 100.

It will be appreciated, in view of the present disclosure, that although FIG. 2 illustrates the extension insert 204 with a particular arrangement of extension insert interface members 206 and illustrates the extension slot 108 with a particular arrangement of extension slot interface members 210, an extension insert 204 and an extension slot 108 may comprise any number of interfacing or interconnecting/interlocking members (e.g., whether planar or non-planar) for removably securing the stretching device extension 110 to the stretching device 100.

Furthermore, although the present disclosure focuses, in at least some respects, on implementations in which the extension slot 108 is disposed on the stretching device 100 and the extension insert 204 is disposed on the stretching device extension 110, one or more slots may be arranged on the stretching device extension 110 and/or one or more inserts may be arranged on the stretching device 100 to facilitate removable attachment of the stretching device extension 110 to the stretching device 100, in accordance with the present disclosure.

Figure 3:
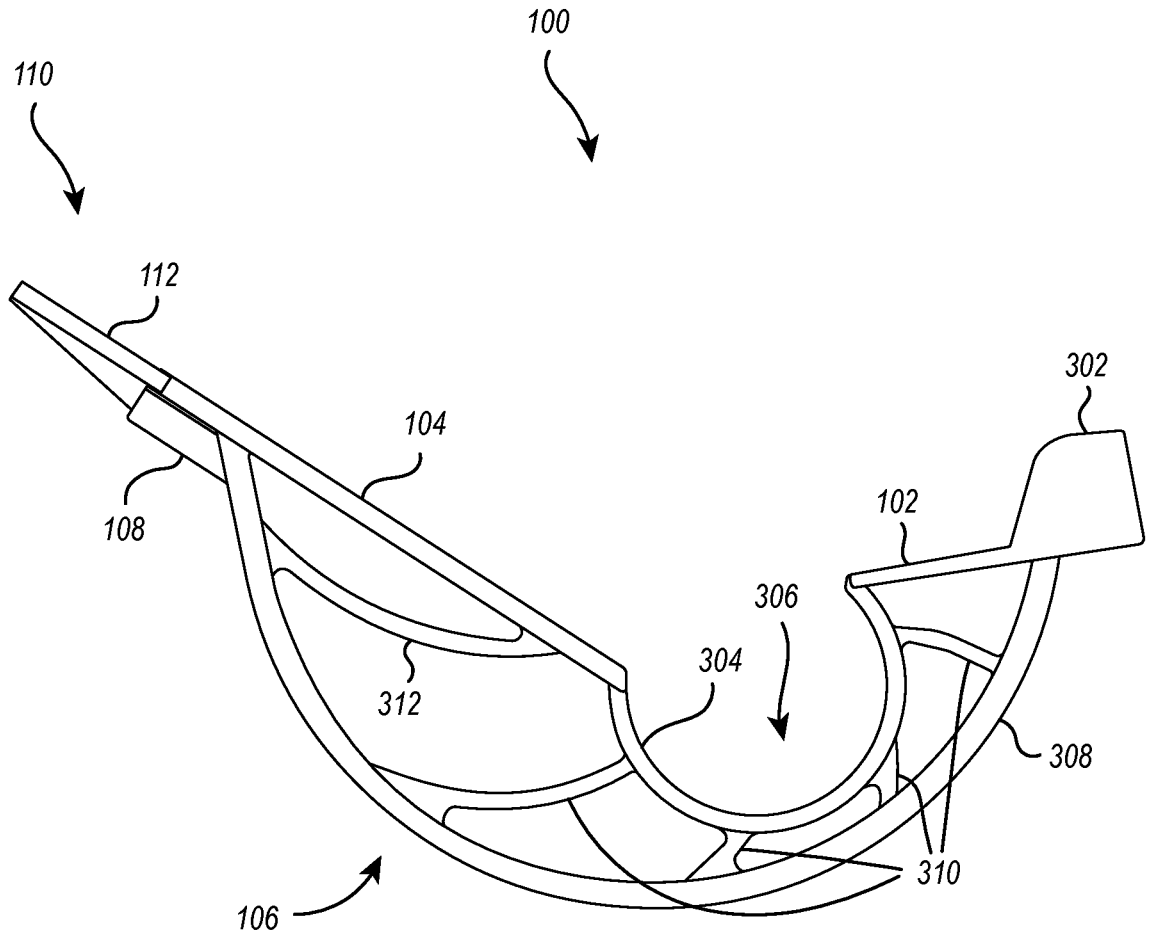
FIG. 3 illustrates a right side view of the stretching device with the stretching device extension attached thereto.

FIG. 3 illustrates a right side view of the stretching device 100 with the stretching device extension 110 attached thereto (e.g., via the extension insert interface members 206 and the extension slot interface members 210). FIG. 3 shows that, in some instances, when the stretching device extension 110 is removably affixed to the stretching device 100, the extension platform 112 becomes arranged substantially coplanar with the ball platform 104. When arranged as illustrated in FIG. 3, the stretching device extension 110 and the stretching device 100 may operate in conjunction to provide desirable stretching functionality and stretching ranges to users who have large foot sizes (e.g., above a men's size 15).

Furthermore, FIG. 3 illustrates that, in some instances, the heel platform 102 includes a heel plate 302 extending vertically about a rear portion of the heel platform 102. The heel plate 302 may allow users to easily maintain proper foot placement on the stretching device 100 during use.

FIG. 3 also illustrates that, in some implementations, the extension slot 108 of the stretching device 100 comprises a substantially trapezoidal profile and may be affixed to one of the connection members 106 (e.g., outer connection member 308, as will be described in more detail hereafter) in addition to being affixed to the underside of the ball platform 104.

Additional details related to the connection members 106 that connect the heel platform 102 to the ball platform 104 will now be provided. FIG. 3 demonstrates that, in some implementations, the connection members 106 include an inner connection member 304. The inner connection member 304 of FIG. 3 forms a curved surface that extends from an end of the heel platform 102 to an end of the ball platform 104. The curved surface of the inner connection member 304 forms a foot gap 306 that intervenes between heel platform 102 and the ball platform 104. In some instances, the foot gap 306 enables the stretching device 100 to provide ideal foot arrangement when a foot is positioned on the heel platform 102 and the ball platform 104, advantageously enabling users to achieve desired stretching positions and/or ranges.

FIG. 3 also illustrates that, in some implementations, the connection members 106 include an outer connection member 308 extending from the heel platform 102 to the ball platform 104. As indicated hereinabove, the extension slot 108 may be connected to the outer connection member 308, in some instances. In addition to connecting the heel platform 102 to the ball platform 104, the outer connection member 106 may comprise a curved surface that enables the rocking functionality described hereinabove for enabling users to achieve desired stretching ranges and/or positions.

The connection members 106 may also include a plurality of connection member supports 310, as illustrated in FIG. 3.

FIG. 3 shows that, in some instances, the connection member supports 310 extend from the inner connection member 304 to the outer connection member 308. For example, the connection member supports 310 may comprise a plurality of surfaces arranged within a space defined by the heel platform 102, the ball platform 104, the inner connection member 304, and the outer connection member 308.

In some implementations, as shown in FIG. 3, at least some of the plurality of surfaces of the connection member supports 310 are curved toward the ball platform 104. For example, the various surfaces of the connection member supports 310 may be regarded as extending outward from the inner connection member 304 and following one or more radii of curvature that cause the various surfaces to bend or curve toward the ball platform 104 or toward the front of the stretching device 100 or toward the extension slot 108.

In addition to the connection member supports 310, the connection members 106 may include, in some instances, an additional support 312, as shown in FIG. 3. The additional support 312 of FIG. 3 extends from the ball platform 104 to the outer connection member 308. Similar to the connection member supports 310, the additional support 312 is illustrated as curving toward the ball platform (or toward the front of the stretching device 100 or toward the extension slot 108).

As demonstrated in FIG. 3, the connection members 106, including the connection member supports 310 and the additional support 312, may be regarded as forming a vortex shape in view of their being curved toward the ball platform 104. The vortex shape of the connection members 106 may provide structural support to the stretching device 100 in a manner that reduces material use/cost (e.g., as compared to forming the stretching device 100 as a solid block of material). Furthermore, in some instances, the connection members 106 may be formed of an elastic material selected to enable the stretching device 100 to flex in response to pressure applied to the heel platform 102 and the ball platform 104 by a foot of a user to allow the stretching device 100 to allow the user to achieve ideal stretching positions/ranges.

Although the present disclosure focuses, in at least some respects, on a stretching device 100 that includes a particular arrangement of connection members 106 (e.g., four connection member supports 310 extending from the inner connection member 304 to the outer connection member 308 and a single additional support 312 extending from the ball platform 104 toward the outer connection member 308), those skilled in the art will understand, in view of the present disclosure, that the connection members 106 can be implemented in various ways in accordance with the present disclosure. For example, a stretching device 100 may include fewer or more than four connection member supports 310 and/or may include fewer or more than one additional support 312. Furthermore, the positioning and/shape (e.g., degree of curvature) of the various connection members 106 may be varied according to the present disclosure.

Figure 4:
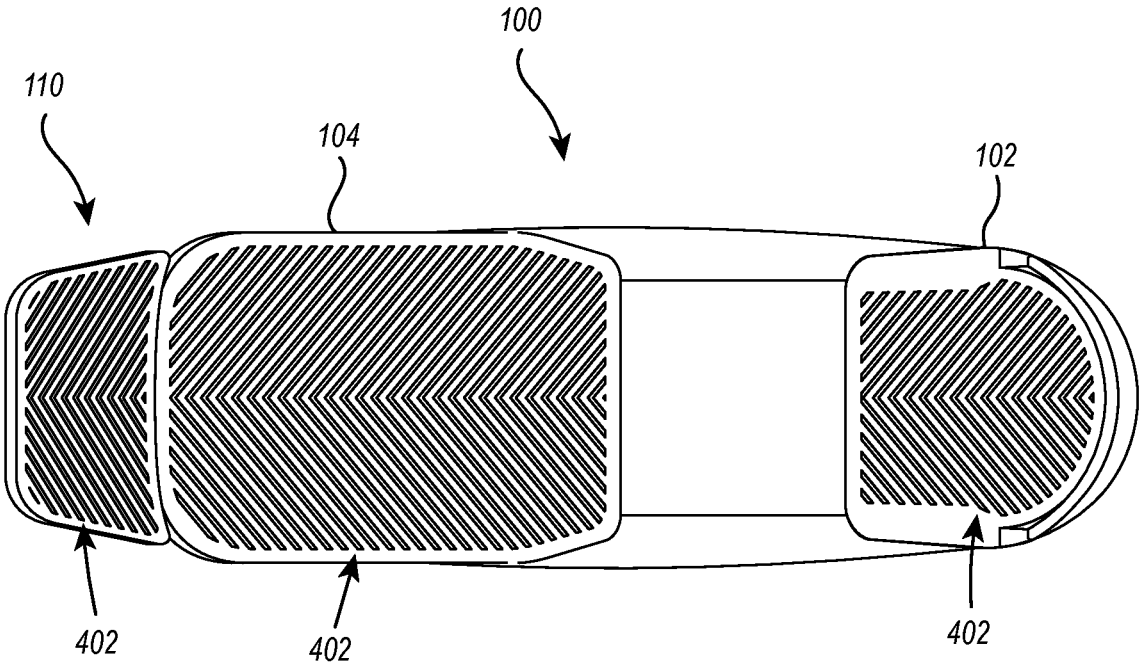
FIG. 4 illustrates a top plan view of the stretching device with the stretching device extension attached thereto.

FIG. 4 illustrates a top plan view of the stretching device 100 with the stretching device extension 110 attached thereto. FIG. 4 illustrates an implementation in which the heel platform 102, the ball platform 104, and the extension platform 112 include treads 402 disposed thereon. The treads 402 may, in some instances, facilitate non-slip contact between a user's foot or footwear and the stretching device, thereby substantially preventing the user's foot or footwear from slipping from placement on the stretching device 100 during use.

Although FIG. 4 focuses on implementations in which the stretching device 100 includes treads 402 on all platforms thereof (e.g., the heel platform 102 and the ball platform 104) and in which the stretching device extension 110 includes treads on the extension platform 112, it will be appreciated, in view of the present disclosure, that any number of the platforms of a stretching device 100 and/or a stretching device extension 110 may include or omit treads, in accordance with implementations of the present disclosure.

Figure 5:
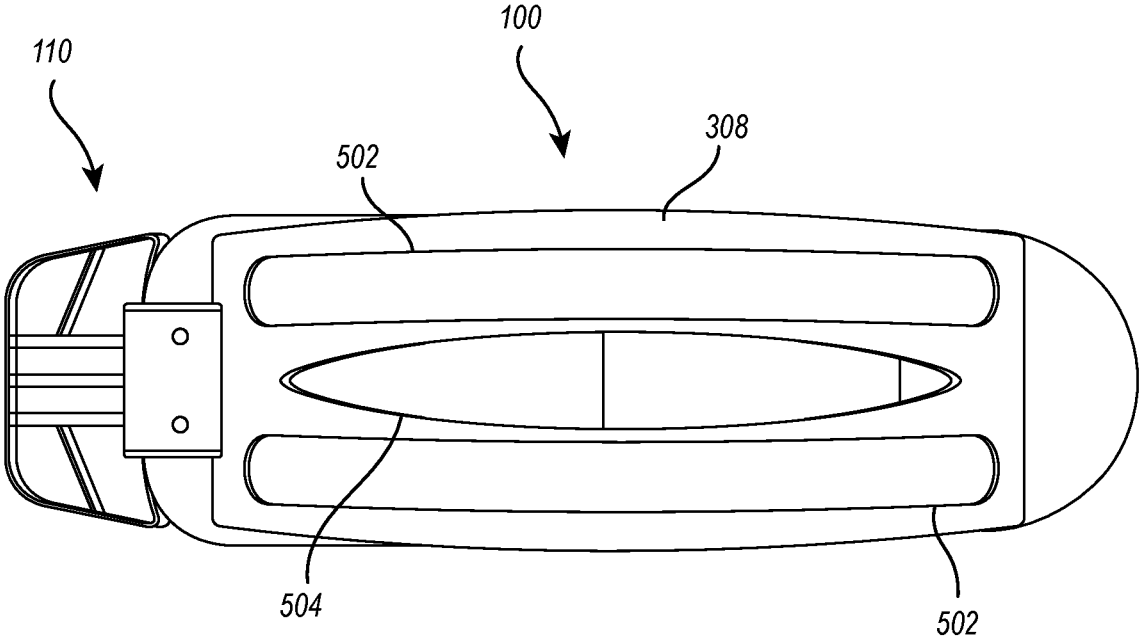
FIG. 5 illustrates a bottom plan view of the stretching device with the stretching device extension attached thereto.

FIG. 5 illustrates a bottom plan view of the stretching device 100 with the stretching device extension 110 attached thereto. FIG. 5 illustrates that, in some implementations, the outer connection member 308 of the connection members 106 described hereinabove with reference to FIG. 3 includes recessed grooves 502 on the outer surface of the outer connection member 308. FIG. 5 illustrates an example in which the recessed grooves 502 are parallel to one another and extend longitudinally across the outer surface of the outer connection member 308, with the two recessed grooves 502 being arranged on opposite transverse sides of the outer surface of the outer connection member 308. The recessed grooves 502 may be configured to receive a grip material (e.g., rubber pads) by any suitable affixation method (e.g., adhesive liquids or strips, etc.). The grip material may, in some instances, prevent slipping of the stretching device 100 during use for stretching (e.g., during rocking motions facilitated by a user).

Additionally, FIG. 5 shows that, in some instances, the outer connection member 308 of the connection members 106 defines an opening 504 across a middle longitudinal section of the outer connection member. FIG. 5 illustrates an example in which the opening 504 is arranged between the recessed grooves 502 described hereinabove. In some implementations, the opening 504 allows the outer connection member 308 to be formed with less material/cost (e.g., as compared with implementations in which the outer connection member 308 omits an opening 504).

The particular configuration of the recessed grooves 502 and the opening 504 is illustrative only and non-limiting. For example, in some instances, a stretching device includes fewer or more than two recessed grooves 502 and/or fewer or more than one opening 504, and the recessed groove(s) 502 and/or opening(s) 504 (if any) may comprise substantially any shape. By way of non-limiting example, a stretching device 100 may omit any opening 504 and may instead include a linear arrangement of recessed grooves 502 that extend in a transvers direction across the outer surface of the outer connection member 308. In yet another example, a stretching device 100 may include a plurality of openings 504 and may omit recessed grooves 502 and may optionally include a grip material adhered to the outer surface of the outer connection member 308 in the absence of the recessed grooves 502. Other examples are also within the scope of this disclosure.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A stretching device, comprising:

a heel platform sized and shaped to support a heel of a foot of a person thereon;

a ball platform sized and shaped to support a ball of a foot of a person thereon, the ball platform being angularly offset relative to the heel platform;

one or more connection members connecting the heel platform to the ball platform;

an extension slot connected to the ball platform; and a stretching device extension comprising an extension platform arranged coplanar with the ball platform such that the extension platform extends adjacent to the ball platform to form an elongating planar extension of the ball platform that operates in conjunction with the ball platform to support a foot of a person thereon, the stretching device extension comprising an extension insert arranged within and selectively removable from the extension slot.

2. The stretching device of claim 1, wherein the extension slot comprises a rectangular opening.

3. The stretching device of claim 1, wherein the extension slot comprises a trapezoidal profile.

4. The stretching device of claim 1, wherein the extension slot is connected to an underside of the ball platform.

5. The stretching device of claim 1, wherein the extension slot comprises one or more extension slot interface members disposed within the extension slot.

6. The stretching device of claim 5, wherein the extension insert of the stretching device extension comprises one or more extension insert interface members configured to interface with the one or more extension slot interface members.

7. The stretching device of claim 6, wherein the stretching device extension comprises one or more extension supports disposed under the extension platform, and wherein the extension insert is at least partially affixed to and extends from the one or more extension supports.

8. The stretching device of claim 7, wherein at least one of the one or more extension supports forms a planar member extending orthogonally from an underside of the extension platform, and wherein an extension insert interface member of the extension insert forms a planar member arranged parallel to the extension platform.

9. The stretching device of claim 1, wherein the heel platform comprises a heel plate extending upward from the heel platform.

10. The stretching device of claim 1, wherein one or more of the heel platform, the ball platform, or the extension platform comprise treads configured to facilitate non-slip contact with a foot of a user or with footwear of the foot of the user.

11. The stretching device of claim 1, wherein the one or more connection members connecting the heel platform to the ball platform comprise an inner connection member between the heel platform and ball platform, the inner connection member defining a foot gap between the heel platform and the ball platform.

12. The stretching device of claim 11, wherein the one or more connection members further comprise an outer connection member between the heel platform and the ball platform.

13. The stretching device of claim 12, wherein the extension slot is at least partially connected to the outer connection member.

14. The stretching device of claim 12, wherein the outer connection member defines an opening on a middle section thereof.

15. The stretching device of claim 12, wherein the outer connection member comprises recessed grooves on an outer surface thereof, the recessed grooves being configured to receive a grip material.

16. The stretching device of claim 12, further comprising a plurality of connection member supports that extend from the inner connection member to the outer connection member.

17. The stretching device of claim 16, wherein the plurality of connection member supports comprises a plurality of surfaces that curve toward the ball platform.

18. The stretching device of claim 17, further comprising an additional support extending from the ball platform to the outer connection member, wherein the additional support curves toward the ball platform.

19. A stretching device, comprising:

a heel platform sized and shaped to support a heel of a foot of a person thereon;

a ball platform sized and shaped to support a ball of a foot of a person thereon, the ball platform being angularly offset relative to the heel platform;

one or more connection members connecting the heel platform to the ball platform; and an extension slot connected to an underside of the ball platform and comprising a front-facing opening adjacent to a front end of the ball platform, the extension slot being configured to receive a stretching device extension comprising an extension platform, the extension platform configured to be arranged coplanar with the ball platform when the extension slot receives the stretching device extension.

20. A stretching device, comprising:

a heel platform sized and shaped to support a heel of a foot of a person thereon;

a ball platform sized and shaped to support a ball of a foot of a person thereon, the ball platform being angularly offset relative to the heel platform;

one or more connection members connecting the heel platform to the ball platform;

an extension slot connected to the ball platform; and a stretching device extension comprising an extension platform arranged coplanar with the ball platform, the stretching device extension comprising an extension insert arranged within and selectively removable from the extension slot, wherein the stretching device extension comprises one or more extension supports disposed under the extension platform, and wherein the extension insert is at least partially affixed to and extends from the one or more extension supports.

* * * * *